US008985648B2

(12) United States Patent
Müller et al.

(10) Patent No.: US 8,985,648 B2
(45) Date of Patent: Mar. 24, 2015

(54) FLUSH HANDLE DEVICE FOR A DOOR OF A VEHICLE

(75) Inventors: Dirk Müller, Essen (DE); Mario Christensen, Mülheim (DE); Stefan Mönig, Schwelm (DE); Christof Brauner, Essen (DE); Martin Witte, Ahaus (DE); Norbert Heller, Viersen (DE)

(73) Assignee: Huf Hulsbeck & Furst GmbH & Co., Velbert (DE)

( * ) Notice: Subject to any disclaimer, the term of this patent is extended or adjusted under 35 U.S.C. 154(b) by 139 days.

(21) Appl. No.: 13/502,706

(22) PCT Filed: Sep. 18, 2010

(86) PCT No.: PCT/DE2010/001112

§ 371 (c)(1),
(2), (4) Date: Apr. 18, 2012

(87) PCT Pub. No.: WO2011/047652

PCT Pub. Date: Apr. 28, 2011

(65) Prior Publication Data

US 2012/0205924 A1 Aug. 16, 2012

(30) Foreign Application Priority Data

Oct. 20, 2009 (DE) ..... 10 2009 045 872

(51) Int. Cl.
*E05B 3/00* (2006.01)
*E05B 85/10* (2014.01)

(52) U.S. Cl.
CPC ..... *E05B 85/107* (2013.01); *E05B 85/103* (2013.01); *Y10S 292/31* (2013.01)
USPC ..... 292/336.3; 292/DIG. 31; 70/208; 70/237

(58) Field of Classification Search
USPC ..... 292/1, 336.3, DIG. 31, DIG. 37, DIG. 65; 70/158, 159, 163, 208, 237, 423, 455
See application file for complete search history.

(56) References Cited

U.S. PATENT DOCUMENTS 2,131,033 A 9/1938 Barrington et al.
2,213,814 A * 9/1940 Jacobi ..... 70/455

(Continued)

FOREIGN PATENT DOCUMENTS

DE 1839349 U 10/1961
DE 40 02 963 C1 7/1991

(Continued)

OTHER PUBLICATIONS

International Search Report under date of Jan. 17, 2011, in connection with PCT/DE2010/001112.

*Primary Examiner* — Kristina Fulton
*Assistant Examiner* — Christine M Mills
(74) *Attorney, Agent, or Firm* — Quarles & Brady LLP

(57) ABSTRACT

A handle device for a lock unit of a vehicle includes a handle part which is movably mounted relative to a door of the vehicle and which can be displaced between a rest position and an operating position. The handle part is flush with the exterior of the door in the rest position and projects from the exterior of the door in the operating position. The handle part can be manually actuated to open the door when in the operating position. The handle device further includes an actuating unit which can be used to transfer the handle part at least from the rest position to the operating position when the actuating unit is activated. The actuating unit includes a cover which can be detached from the actuating unit and a lock cylinder arranged in the handle device, such that the lock cylinder can be released by detaching the cover.

19 Claims, 5 Drawing Sheets

(56) References Cited

U.S. PATENT DOCUMENTS

Figure 1:
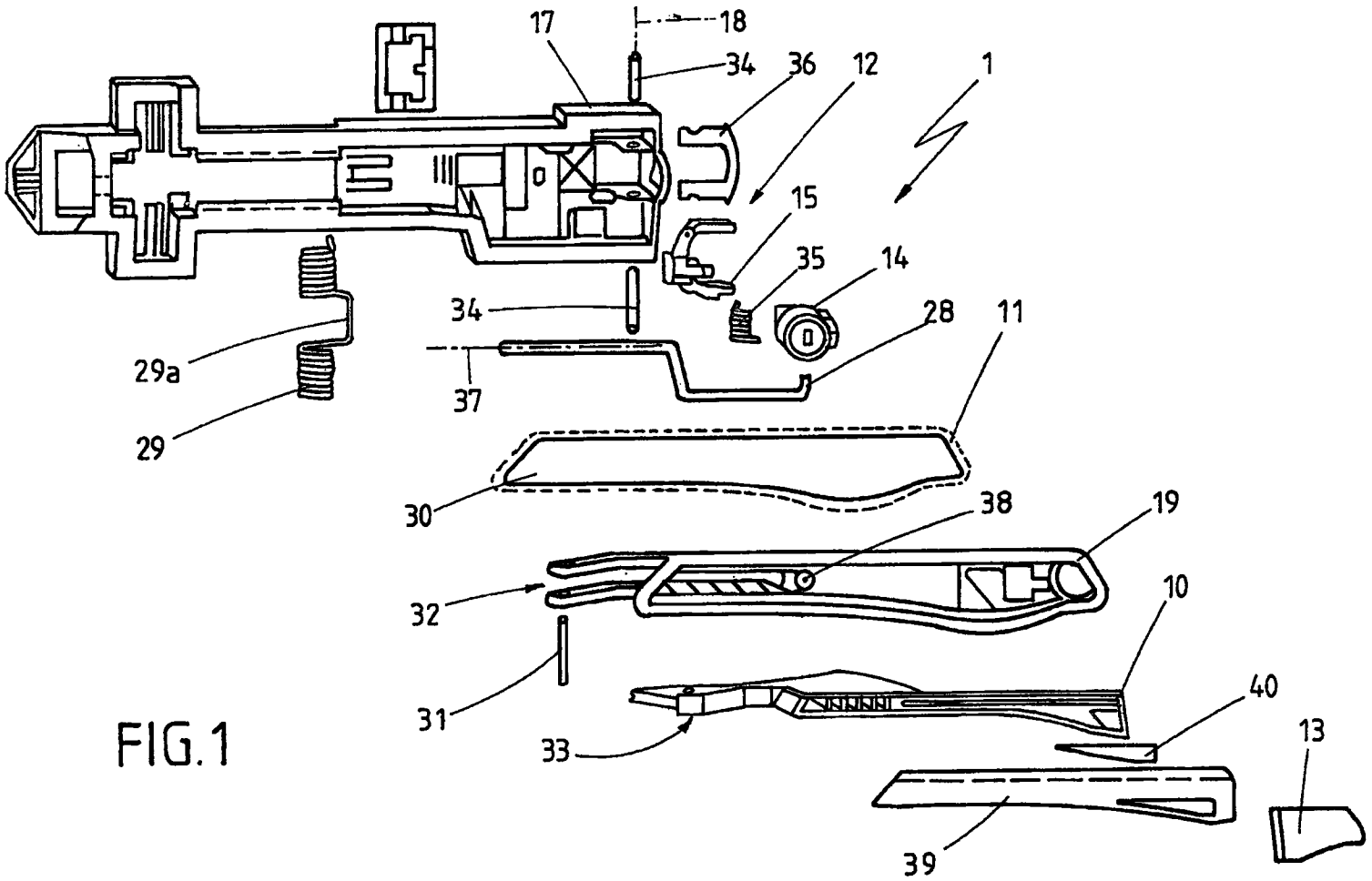

| | | | | |
|---|---|---|---|---|
| 5,123,687 | A | 6/1992 | Pfeiffer et al. | |
| 5,904,385 | A * | 5/1999 | Linder | 292/336.3 |
| 6,158,788 | A | 12/2000 | Ikeda et al. | |
| 6,696,652 | B1 * | 2/2004 | Spies | 200/61.62 |
| 6,698,262 | B2 * | 3/2004 | Wittwer | 292/336.3 |
| 7,387,004 | B2 * | 6/2008 | Schutz et al. | 70/208 |
| 7,543,863 | B2 * | 6/2009 | Herbert et al. | 292/336.3 |
| 2008/0190157 | A1 * | 8/2008 | Mizuno | 70/455 |

FOREIGN PATENT DOCUMENTS

| | | | |
|---|---|---|---|
| DE | 4002963 | C1 | 7/1991 |
| DE | 197 31 325 | A1 | 1/1999 |
| DE | 198 27 132 | B4 | 12/1999 |
| DE | 19827132 | A1 * | 12/1999 |
| DE | 19943497 | A1 * | 3/2001 |
| DE | 10015887 | C1 | 1/2002 |
| DE | 10309821 | A1 | 9/2004 |
| DE | 10 2004 036663 | A1 | 3/2006 |
| DE | 102004045152 | A1 | 3/2006 |
| DE | 10 2006 060540 | A1 | 6/2008 |
| DE | 102008019335 | A1 | 10/2008 |
| DE | 102008028391 | A1 | 12/2009 |
| EP | 0 822 306 | A2 | 2/1998 |
| EP | 1607555 | A2 | 12/2005 |
| WO | 01/75252 | A1 | 10/2001 |
| WO | WO 2008022896 | A1 * | 2/2008 |
| WO | WO 2008129003 | A2 * | 10/2008 |

* cited by examiner

FLUSH HANDLE DEVICE FOR A DOOR OF A VEHICLE

CROSS-REFERENCE TO RELATED APPLICATIONS

This application claims priority to PCT International Application No. PCT/DE2010/001112 filed on Sep. 18, 2010, which claims priority to German Patent Application No. 10 2009 045 872.7 filed on Oct. 20, 2009, both of which are fully incorporated by reference herein.

The present invention relates to a handle device of a locking device of a vehicle, with a handle part which is mounted movably with respect to a door of the vehicle and is movable between a rest position and an operating position, wherein, in the rest position, the handle part is arranged flush with the outer side of the door and, in the operating position, protrudes out of the outer side of the door in the manner of a projection, wherein the handle part can be operated manually in the operating position in order to open the door, and wherein, furthermore, an actuating unit is provided, by means of which, when the actuating unit is activated, the handle part can be transferred at least from the rest position into the operating position.

DE 10 2004 036 663 A1 discloses a generic handle device of a locking device of a vehicle. In the present case, the handle device describes the device arranged in the door of the vehicle. By contrast, the locking device comprises the entire locking system, and therefore the handle device constitutes part of the locking device which preferably comprises all of the handle devices on the vehicle and a central locking system and, for example, a control unit for the latter. In particular, the locking device comprises a lock which interacts with the handle device such that the handle device has to be operated manually in order to open the lock of the door, after which the door opens.

The actuating unit of the arrangement shown is designed as an unlocking button which has to be pressed in order to activate an internal mechanism which causes the handle part to project into the operating position. In order to return the handle, a locking button has to be pressed, as a result of which the handle part is returned into the rest position. It is disadvantageous, however, that the handle device does not have any means in order to lock or to unlock the door of the vehicle with a key. Although locking cylinders are generally known for this purpose, said locking cylinders cannot be integrated, according to the prior art, in flush handle devices of the type of interest here.

It is therefore the object of the present invention to provide a flush handle device which has an extended functional scope while retaining a flush configuration of the handle device.

This object is achieved based on a handle device according to the preamble of claim 1 in conjunction with the characterizing features. Advantageous developments of the invention are indicated in the dependent claims.

The invention includes the technical teaching that the actuating unit has a cover which can be detached from the actuating unit, and a locking cylinder is provided and is arranged in the handle device in such a manner that the locking cylinder can be released by detaching of the cover.

The invention is based here on the concept of extending the functional scope of the handle device by integration of a locking cylinder, wherein the latter is arranged in such a manner that the flush design of the handle device for a door of a vehicle is retained. According to the invention, the unlocking button known from the prior art is not designed, inter alia, as a simple button but rather the actuating unit formed therewith comprises a cover which constitutes the button for manual operation and which is arranged detachably on the actuating unit in order to release the locking cylinder as required. In the present case, the release of the locking cylinder describes at least a release of the front side, from which a key can be introduced into the locking channel of the locking cylinder. During customary operation of the handle device, the cover can conceal the locking cylinder, since the handle device is connected to a central locking system via the locking device, and therefore the locking cylinder has to be operated with a key only when the central locking system fails or malfunctions. In particular, the locking cylinder does not have to be arranged next to the handle device in the door of the vehicle and can be integrated in an advantageous manner in the handle device without having a negative influence on the appearance and the handling of the handle device.

In a rest position of the actuating unit, the cover is advantageously arranged flush with the outer side of the door and can be transferred by manual actuation into an activation position. In order to configure the handle device so as to be arranged completely flush with the outer side of the door of the vehicle, the cover also merges flush into the outer side of the door. Furthermore, the handle part can have an outer cover which is likewise formed flush with the cover of the actuating unit and the outer side of the door of the vehicle. The manual actuation can take place by pressing on the cover with a finger, wherein the direction of movement of the cover does not have to be fixed. In particular, the cover can be movable in a pivoting manner, which is discussed in more detail below. In any case, in the activation position, the cover is in a position in which it is pressed or pivoted into the handle device and in which the cover is located on the inside behind the flush transition between the outer side of the door, the handle device and the cover on the handle part. In particular, this affords the advantage that wind noises are reduced, and there is less risk of an accident, since the handle device is not formed by any parts protruding out of the outer skin of the vehicle. Furthermore, no soiling of the parts to be operated manually takes place, which can be considered a further advantage.

Furthermore, it is advantageous that the actuating unit has an actuating element, the cover being arranged on the actuating element. The actuating element describes the movable part of the actuating unit, wherein a blocking element can be connected to the actuating element, the blocking element being operatively connected to the handle part in order at least to unblock the latter and transfer it from the rest position into the operating position. In this case, the blocking element is activated by manual operation of the cover and consequently movement of the actuating element, and therefore the actuating unit constitutes a drive for activating the blocking element.

According to a further advantageous embodiment of the handle device, the actuating element can have a receiving extension, the cover for arrangement on the actuating element having a detachable connection to the receiving extension. In particular, a handle mount can be provided, the handle mount being formed at least as part of a basic structure of the handle device and preferably being arranged on the inner side of the door. In this case, the actuating element can be accommodated pivotably on the handle mount, and therefore the actuating element is mounted on a pivot axis in the handle mount. If the cover is preferably arranged on the end side of the receiving extension, and if the cover is pressed by manual pressure, similarly to operation of a button, in the direction of the inner side of the handle device and consequently in the direction of the handle mount, the cover can pivot with the actuating element about the pivot axis.

The handle device preferably has a handle shell with an elongate extent in which, at least in the rest position, the handle part lies with a likewise elongate extent flush with the outer side of the door, the cover being arranged as an extension of the elongate extent of the handle and preferably adjacent to the handle part. In particular, the handle shell can be fitted with the handle part from the outer side of the door, the handle mount together with the actuating unit being fitted from the inner side of the door. Consequently, the handle shell and the handle mount can be screwed to each other by means of at least one screw element in order to fixedly arrange the handle mount and the handle shell on the door. In this case, the handle shell forms the basic structure of the handle device equally with the handle mount. Since the actuating element is fitted on the inner side of the door, the handle shell has an opening through which the receiving extension of the actuating element extends. When the handle shell is fitted, the actuating unit is not visible from the outer side or is visible merely in the form of the receiving extension, wherein the latter is substantially concealed by the fitted cover.

The cover advantageously conceals the locking cylinder with respect to the outer side of the handle device, the cover partially releasing the locking cylinder again upon manual actuation. However, the resulting release of the locking cylinder does not have to be sufficient in order to operate the latter with a key. Consequently, the cover only has to be detached from the actuating unit, in particular from the receiving extension, in order to release the locking cylinder far enough for a key to be introduced into the locking channel of the locking cylinder. Since, however, the locking cylinder appears visible from the outer side only when the cover is actuated, the overall appearance of the handle device in the nonactivated state is created such that a locking cylinder is not visible from the outer side. In particular, according to the arrangement according to the invention, the locking cylinder does not have to be placed adjacent to the handle device in the door panel of the door of the vehicle but rather may be an integral part of the handle device.

Furthermore advantageously, upon actuation of the actuating unit, the cover pivots in the direction of the handle part, and therefore the cover preferably pivots under the handle part. The space in between the handle part, in particular between the cover on the handle part and the cover of the actuating unit, is dimensioned in such a manner that, when the cover is pivoted in the direction of the handle part, there is no contact of the cover with the handle part. In the process, the cover at least partially pivots under the handle part, and therefore said cover does not have to be pressed vertically into the handle device, in particular vertically into the handle shell, by manual operation but rather the cover can be pivoted by manual guidance about the pivot axis which is arranged and incorporated on the inside of the handle mount.

The cover is preferably fastened in a form-fitting manner to the actuating element, and the form-fitting connection can be released by movement of the cover in a removal direction relative to the receiving extension of the actuating element. In this case, provision may be made for the form-fitting connection between the cover and the actuating element to have a slot guide, and therefore the form-fitting connection can be released by movement of the cover in the slot guide direction, and therefore at least one slot spring can be released from at least one slot recess. The slot guide, also known as a dovetail guide or T guide, can preferably comprise two slot recesses which are arranged either on the inside of the cover or on the receiving extension. The edges of the slot spring can be enclosed by the groove recesses, and therefore the cover can be latched to the actuating element by said cover being moved counter to the slot guide direction until the slot spring latches in the groove recesses.

Furthermore advantageously, the cover can have a tool guide into which a tool can be introduced, the tool guide preferably being accessible whenever the cover is transferred by manual actuation into the activation position. In this case, the actuating element and preferably the receiving extension can have a latching means which can be latched into a mating latching means on the cover in order to prevent movement of the cover in the slot guide direction and therefore in the removal direction.

The latching means can be arranged as an extension of the tool guide, and therefore, upon introduction of the tool into the tool guide and by interaction of the tool with the latching means, the latching means can be detached from the mating latching means. The latching means can latch in the mating latching means in the manner of a snap-type connector, wherein the latching means can have, for example, a latching lug, and the mating latching means can form a latching groove. If, therefore, the slot spring on the receiving extension is introduced into the slot recesses, this takes place in the slot guide direction. In the process, the latching hook of the latching means approaches the latching groove of the mating latching means on the cover. The slot spring is guided further in the groove recesses until the latching hook of the latching means latches into the latching groove of the mating latching means. The cover can then only be detached by interaction of the tool with the latching means, wherein the tool lifts the latching hook out of the latching groove. Consequently, the cover can be guided in the slot guide direction and consequently in the removal direction along the receiving extension until the slot spring is no longer enclosed in a form-fitting manner by the slot recesses.

According to a further advantage of the handle device, the geometrical configuration of the tool guide and in particular the interaction of the tool with the latching means are designed in such a manner that the tool can be configured in the form of a key which is provided in particular for actuating the locking cylinder. The tool guide can be present as a flat depression on the inside of the cover, along which, for example, a key which is likewise flat can be guided. In this case, the key is guided along the tool guide until the key comes into contact with the latching means and consequently with the latching lug. In this case, the front side of the latching lug has a bevel, and the key lifts the latching lug out of the latching groove. If the cover is then moved in the removal direction without the actuating element being pivoted further, the cover can be removed and the locking cylinder is exposed. The locking cylinder can subsequently be operated with the key.

The object addressed by the present invention is furthermore achieved by a method for releasing a locking cylinder of a locking device of a vehicle, wherein the handle device is designed with a handle part which is mounted movably with respect to a door of the vehicle and is movable between a rest position and an operating position, wherein, in the rest position, the handle part is arranged flush with respect to the outer side of the door and, in the operating position, protrudes out of the outer side of the door in the manner of a projection, wherein the handle part can be operated manually in the operating position in order to open the door, and wherein, furthermore, an actuating unit is provided, by means of which, when the actuating unit is activated, the handle part can be transferred at least from the rest position into the operating position. The method according to the invention includes the technical teaching of the actuating unit having a cover which can be detached from the actuating unit, and of a tool being provided, with which tool the connection between the cover and the actuating unit is detached, and of the locking cylinder being arranged in the handle device in such a manner that the locking cylinder is released by detaching of the cover.

The detaching of the cover from the actuating unit by means of the tool comprises introducing the tool into a tool guide on the cover, wherein the cover is transferred by manual actuation into the activation position in order to render the tool guide accessible.

In a development, the actuating element and preferably the receiving extension has a latching means which is latched into a mating latching means on the cover in order to prevent movement of the cover in the removal direction and in particular in the slot guide direction. In this case, the latching means is arranged as an extension of the tool guide, and therefore, upon introduction of the tool into the tool guide and by interaction of the tool with the latching means, the latching means is detached from the mating latching means.

The method according to the invention in particular has the steps of manually actuating the actuating unit, introducing a tool into a tool guide in the cover, detaching the latching connection of the latching means from the mating latching means, moving the cover in the removal direction and removing the cover.

Figure 2:
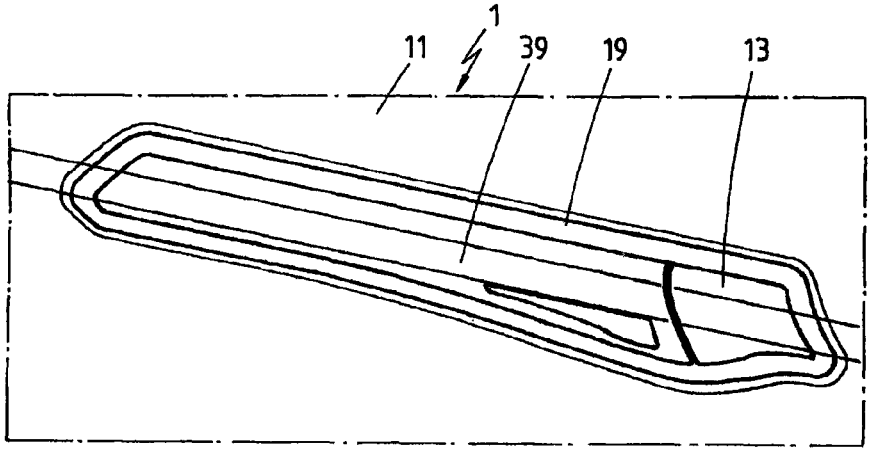
Figure 3:
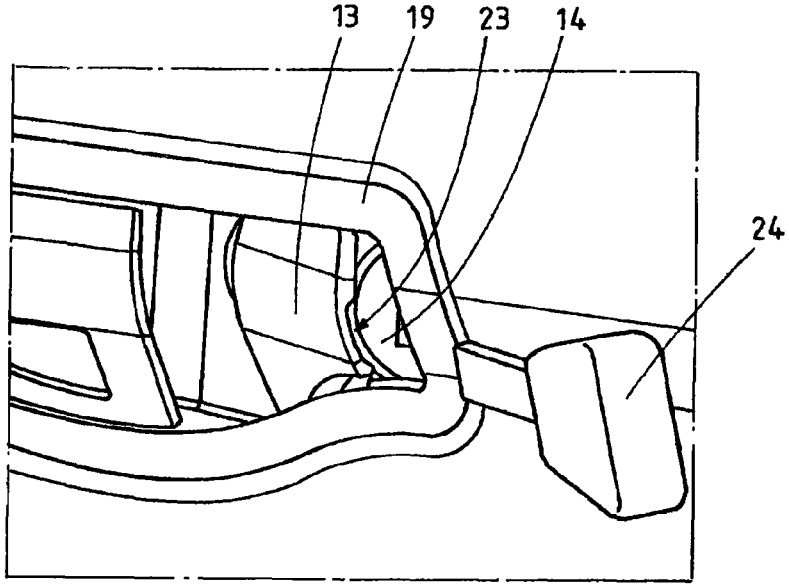
Figure 4:
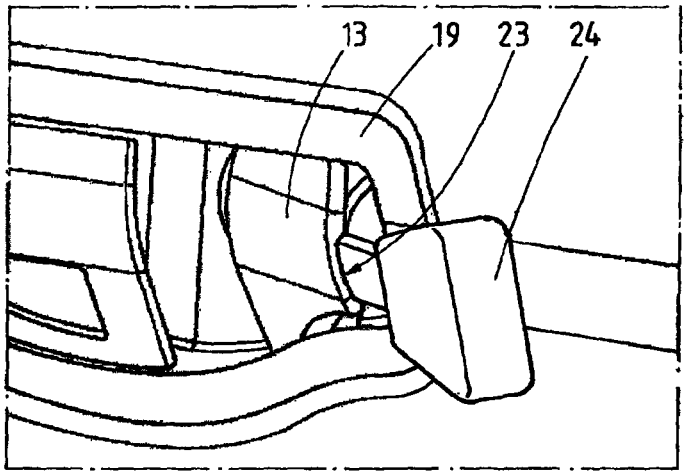
Figure 5:
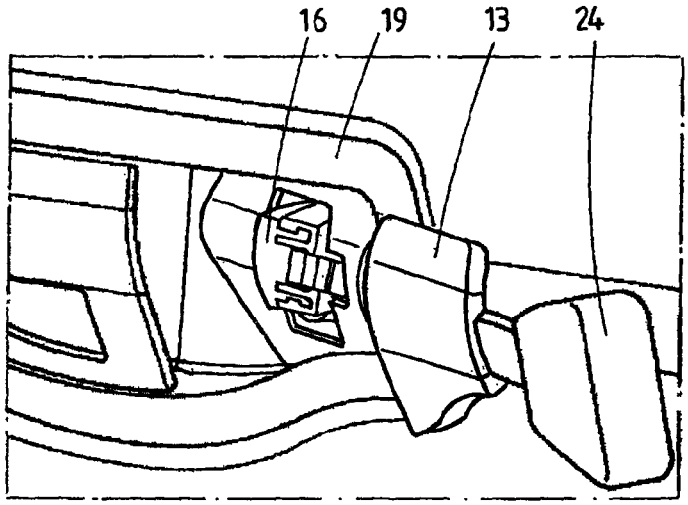
Figure 6:
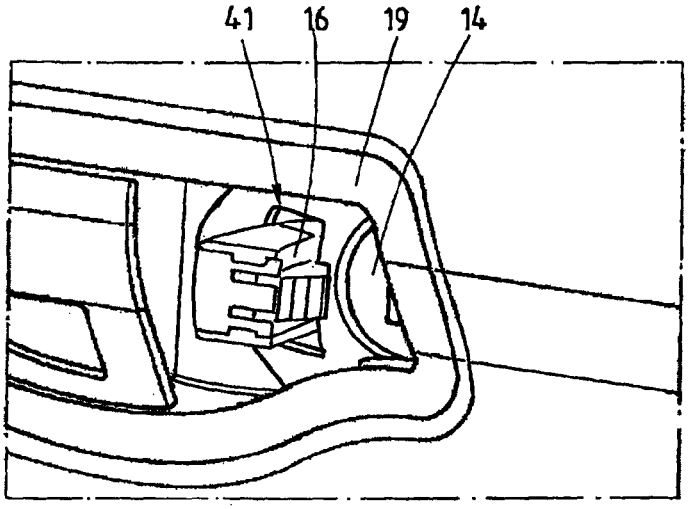
Figure 7:
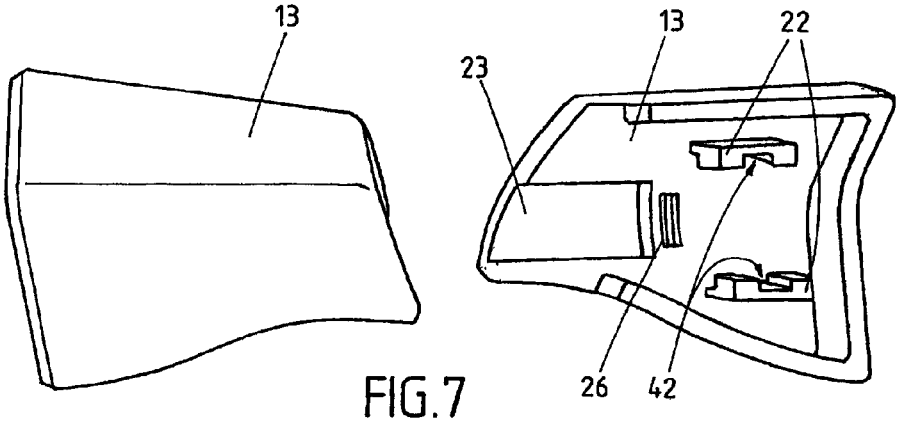
Figure 8:
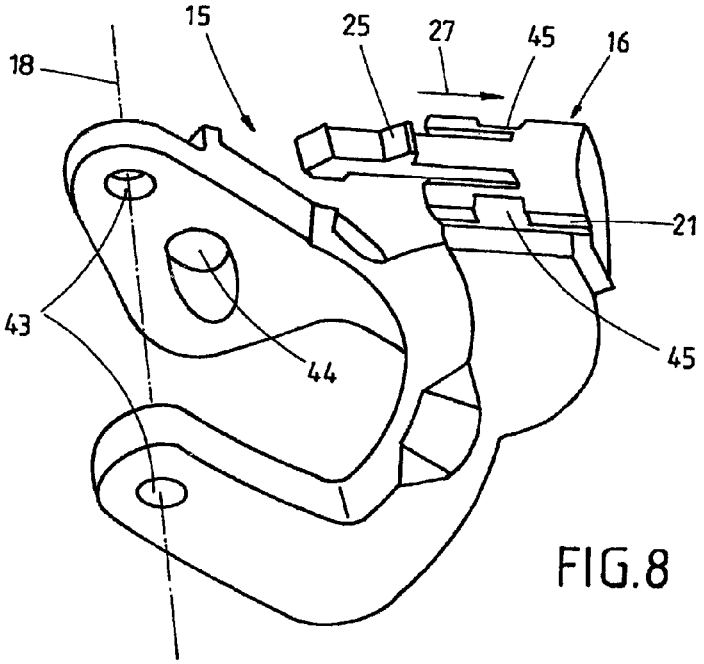
Figure 9:
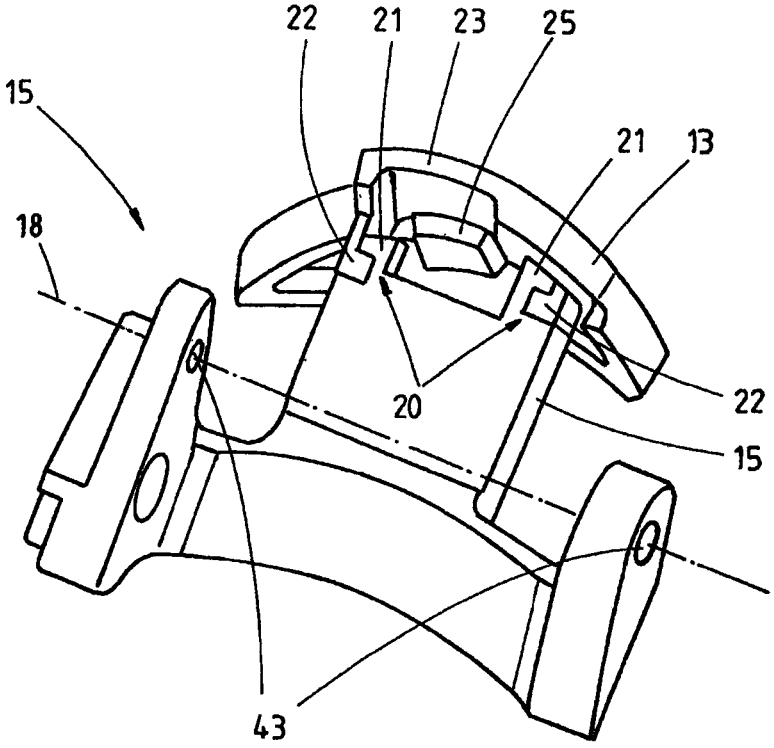

Further measures improving the invention are explained in more detail below together with the description of a preferred exemplary embodiment of the invention with reference to the figures, in which:

FIG. 1 shows an exemplary embodiment of the handle device according to the present invention in a floating arrangement, FIG. 2 shows the handle device in a flush arrangement in the door of a vehicle, FIG. 3 shows a detail of the handle device according to FIG. 2, wherein the cover is transferred from a rest position into an activation position by manual actuation, FIG. 4 shows the handle device according to FIG. 3, wherein a tool is inserted in the form of a key in order to remove the cover, FIG. 5 shows the handle device according to FIG. 4, wherein the cover is removed from the handle device, FIG. 6 shows the handle device with a removed cover, FIG. 7 shows a perspective view of the cover on the left from an outer side and on the right from an inner side, FIG. 8 shows a first illustration of an actuating element without a cover, and FIG. 9 shows a second illustration of the actuating element with a cover arranged thereon.

FIG. 1 shows an exemplary embodiment of a handle device 1 according to the present invention in a floating view. The components of the handle device 1 are reproduced in an arrangement in which each is shown in front of another with the installation sequence being substantially maintained such that the manner in which the handle device 1 is fitted is clear. The door 11 of a vehicle, which door, indicated schematically, is reproduced by a door opening 30, serves as the means of receiving the handle device 1. The handle device 1 is fitted onto said door opening 30 and is therefore arranged so as to be held on the door 11. It is therefore described below how and which components are fitted to one another and in relation to one another from the outer side of the door 11 and how and which components are fitted to one another and in relation to one another from the inner side of the door 11.

The components illustrated in front of the door 11 are fitted from the outer side whereas the components illustrated behind the door 11 are fitted from the inner side. First of all, a handle part 10 can be accommodated pivotably in a handle shell 19, wherein the connection between the handle part 10 and the handle shell 19 can be produced by a pivoting spindle element 31. A receiving fork 32 is located on the handle shell 19, and an articulated section 33 of the handle part 10 can be received between the receiving fork 32 and bolted to the pivoting spindle element 31. The handle part 10 is therefore accommodated pivotably in the handle shell 19, and a first module is created, which module can be handled individually as a structural unit and can be placed onto the door 11 from the outer side.

In order to create a second, individually handleable module for installation, a handle mount 17 is provided, the handle mount serving as a basic structure of the handle device 1 and being arrangeable from the inner side against the door opening 30 of the door 11. An actuating element 15 which forms part of an actuating unit 12 is fitted on the door mount 17. The actuating element 15 is installed via cylinder pins 34 which can be introduced into bores or receptacles present in the handle mount 17. The actuating element 15 has a fork shape, and therefore the fork ends of the actuating element 15 are held by the cylinder pins 34 on the handle mount 17. As a result, the actuating element 15 is pivottable about a pivot axis 18 which is formed at the same time by the respective longitudinal extent of the cylinder pins 34. The actuating element 15 is prestressed by a spring element 35 into a position which reproduces the rest position of the actuating unit 12. In this case, the spring element 35 can be arranged in such a manner that said spring element surrounds the cylinder pin 34 illustrated on the bottom side.

Furthermore, a locking cylinder 14 is shown, the locking cylinder being inserted into the handle mount 17 and being fastened captively in the handle mount 17 by a clamping disk 36. Furthermore, a blocking element 28 is shown, the blocking element being connected to the actuating element 15 at one point such that the connection is formed at a distance from the pivot axis 18. If the actuating element 15 is pivoted about the pivot axis 18 by manual actuation, the blocking element 28, preferably designed as a wire or rod element, executes a movement on a movement axis 37.

The blocking element 28 serves both to lock, unlock and also to deploy the handle part 10 from the rest position into the operating position. At the same time, the blocking element 28 forms a crash interlock by means of the locking function, and therefore the blocking element 28 prevents the handle part 10 from being able to pass from the rest position into the operating position if acceleration forces act on the handle part 10. For example, in the event of an accident, an acceleration force can act on the handle part 10, the acceleration force sufficing in order to transfer the handle part from the rest position into the operating position. By means of the arrangement of the blocking element 28, preferably in such a manner that a form-fitting connection is produced between the handle part 10 and the handle mount 17, the handle part can be transferred into the operating position exclusively when the actuating element 15 of the actuating unit 12 is activated. The activation takes place here by the actuating element 15 pivoting about the pivot axis 18. Only then is the form-fitting connection between the handle part 10 and the handle mount 17 released, owing to a movement of the blocking element 28 in the direction of the movement axis 37, such that only then can the handle part 10 be moved. As a result, a permanent crash interlock is produced for the handle part 10, said crash interlock being released exclusively when the actuating unit 12 is activated.

If the handle mount 17 is premanufactured with the above-mentioned components, this can form the second module which is screwed against the first module. For this purpose, a screw element can be passed through a screw opening 38 and screwed into the handle mount. The first module is therefore screwed against the second module, and the handle device 1 is arranged fixedly on the door 11. A further cover 39 can then be arranged on the handle part 10, wherein, in a development, a light-generating unit 40 can be provided, which unit can be inserted into the cover 39 in order to provide outside illumination of the vehicle and/or, for example, to supply a position light for the handle device 1.

Furthermore, a spring element 29 can be provided, the spring element being configured as a double leg spring and coming to rest with a bridge section 29*a* against the handle part 10, and preferably against the receiving fork 32 of the handle part 10, in a force-exerting manner. The spring element 29 prestresses the handle part 10 in the direction of the rest position such that the handle part 10 has to be transferred from the rest position into the operating position counter to the prestressing of the spring element 29 by the actuating unit 12 being actuated, and the blocking element 28 being displaced in the direction of the movement axis 37. In the process, not only is a form-fitting connection, which is produced by the blocking element 28, between the handle part 10 and the handle mount 17 released, but the blocking element 28 additionally presses the handle part 10 into the operating position counter to the prestressing of the spring element 29.

FIG. 2 shows a perspective view of the handle device 1 which is installed in the door 11 of a vehicle. The handle shell 19, in which the handle part 10 lies, can be seen here, wherein the cover 39 together with the cover 13 of the actuating unit ends flush with the door 11. The covers 13 and 39 end flush with a simultaneously flush transition of the edge formed by the handle shell 19. As a result, the handle device 1 is integrated into the outer skin of the door 11 without a step, a protruding part or a geometrically set-back arrangement of the handle device 1 being formed. In particular, a recessed grip, by means of which manual enclosing of the handle part of the handle device 1 would be possible, is not present. In order to operate the handle device 1, first of all the cover 13 has to be pressed manually such that the latter pivots in the direction of the cover 39. As a result, by means of displacement of the blocking element 28 on the movement axis 37, the form-fitting connection between the handle part 10 and the handle mount 17 is released to an extent such that the handle part 10 can rotate about the pivoting spindle element 31 in the receiving fork 32 of the handle shell 19. In the process, the handle part 10 passes into an operating position, and therefore said handle part can be manually enclosed. The operator can then pull on the handle part 10 in order to transfer the latter from a first operating position into a second operating position. The door 11 of the vehicle thereupon opens.

FIG. 3 shows the cover 13 after manual actuation of the actuating unit. The locking cylinder 14 is partially released by pivoting of the cover 13. If the cover 13 in the arrangement shown is at least partially pivoted, the pivoting can only take place as far as a point without the handle part 10 already being moved from the rest position into the operating position. The pivoted arrangement of the cover 13 opens up a tool guide 23 which is fitted on the underside of the cover 13. The tool guide 23 is designed in the manner of a groove, and therefore a tool 24, in the present case a key 24, can be introduced into the tool guide 23.

FIG. 4 shows the key 24 in the manner in which the latter is already introduced into the tool guide 23 on the inside of the cover 13. By interaction of the tool 24, which is designed in the form of a key 24, with the connection between the cover 13 and the actuating element, the cover 13 can be detached from the actuating unit. Consequently, the cover can be removed from the handle shell 19, and therefore the locking cylinder 14 is released.

FIG. 5 shows the removal of the cover 13 from a receiving extension 16 which is integrally formed on the actuating element 15 of the actuating unit 12. The cover 13 together with the key 24 can be pulled off from the handle device 1.

FIG. 6 shows the handle device 1 with a removed cover 13. In this case, only the receiving extension 16 of the actuating element 15 protrudes from the handle shell 19 which has an opening 41 through which the receiving extension 16 of the actuating element 15 extends.

FIG. 7 shows, in a perspective view, on the left side the outer side and on the right side the inner side of the cover 13. In the inner side of the cover 13 there are slot recesses 22 which are preferably formed integrally with the cover 13. The cover 13 can be produced as a plastics injection molded part, and therefore the slot recesses 22 are integrally formed on the inside of the cover 13. Furthermore, a mating latching means 26 in the form of a latching groove is shown. The slot recesses 22 have cutouts 42 which serve as interruptions to the slot recesses 22. Furthermore, a tool guide 23 is shown, which tool guide is introduced in the form of a slot-like depression on the inside of the cover 13.

FIGS. 8 and 9 show a perspective view of the actuating element 15 with the receiving extension 16. In order to arrange the actuating element 15 so as to be pivotable about the pivot axis 18, and in order to pass the cylinder pins 34 through the legs of the fork-shaped actuating element 15, bolt openings 43 through which the cylinder pins 34 can be passed are shown at the end of the legs of the actuating element 15. An articulated arrangement is therefore formed, and the actuating element 15 can pivot about the pivot axis 18.

Furthermore, a receiving slot 44 is shown, into which the rod-like blocking element 28 is fitted. If the actuating element 15 pivots about the pivot axis 18, the blocking element 28 can be moved on the movement axis 37 as a result.

Furthermore, the receiving extension 16 of the actuating element 15 is illustrated in more detail. The receiving extension 16 has a slot spring 21 which has cutouts 45 which can interact with the cutouts 42 of the slot recesses 22. If the cover 13 is arranged on the receiving extension 16 in a form-fitting manner, the cover 13 is pushed onto the receiving extension 16 counter to the removal direction 27. In the process, the outer sides of the slot spring 21 are pushed into the slot recesses 22. Consequently, the slot spring 21 is accommodated between the slot recesses 22. In the fastening position, the latching means 25 in the form of a latching lug latches into the mating latching means 26 on the cover 13, which is in the form of a latching groove. In the latched position, the position of the cutouts 42 on the slot recesses 22 in the removal direction 27 does not coincide with the position of the cutouts 45 on the slot spring 21. If, however, the tongue-like latching means 25 which is movable in a spring-elastic manner is elastically deformed with a tool 24 counter to the arrangement of the cover 13, the latching means 25 passes out of the mating latching means 26. Consequently, the cover 13 is movable in the removal direction 27, at least until the cutouts 42 of the slot recesses 22 coincide with the cutouts 45 of the slot spring 21. As a result, the cover 13 can be removed, since the form-fitting connection is now released.

FIG. 9 shows a view in the form-fitting connection between the receiving extension 16 of the actuating element 15 and the cover 13. A front view of the latching means 25 is shown here showing how the latter is latched to the mating latching means on the cover 13. Furthermore, the view is shown of how the form-fitting connection between the slot spring 21 and the slot recesses 22 of the slot guide 20 is formed. If a key 24 having a substantially rectangular cross section is now introduced into the tool guide 23, the front side of the key 24 strikes against a slope which is present on the front side of the latching means 25. The latching means 25 is therefore elastically deformed in the arrow direction shown, and the latching means 25 passes out of the mating latching means 26 of the cover 13.

The invention is not restricted in the design thereof to the above-stated preferred exemplary embodiment. On the contrary, a number of alternatives making use of the solution illustrated in fundamentally different types of embodiments is also conceivable. All of the features and/or advantages revealed in the claims, the description or the drawings, including structural details, three-dimensional arrangements and method steps, may be essential to the invention both by themselves and in very different combinations.

LIST OF DESIGNATIONS

1 Handle device
10 Handle part
11 Door
12 Actuating unit
13 Cover
14 Locking cylinder
15 Actuating element
16 Receiving extension
17 Handle mount
18 Pivot axis
19 Handle shell
20 Slot guide
21 Slot spring
22 Slot recess
23 Tool guide
24 Tool, key
25 Latching means (on the receiving extension)
26 Mating latching means (on the cover)
27 Removal direction
28 Blocking element
29 Spring element
29*a* Bridge section
30 Door opening
31 Pivoting spindle element
32 Receiving fork
33 Articulated section
34 Cylinder pin
35 Spring element
36 Clamping disk
37 Movement axis
38 Screw opening
39 Cover
40 Light-generating unit
41 Opening
42 Cutout
43 Bolt opening
44 Receiving slot
45 Cutout

The invention claimed is:

1. A handle device of a locking device of a vehicle, said handle device comprising:

a handle part movably mountable with respect to a door of the vehicle and movable between a rest position and an operating position, wherein, in the rest position, the handle part is arranged flush with an outer side of the door and, in the operating position, protrudes out of the outer side of the door, wherein the handle part can be operated manually in the operating position in order to open the door;

a movably mounted actuating unit operatively connected to the handle part and transferring the handle part at least from the rest position into the operating position;

a locking cylinder arranged in the handle device;

a cover detachably mounted directly to the actuating unit and covering the locking cylinder, wherein, in the rest position, the cover is arranged flush with an outer side of the door and can be transferred by manual actuation into an activation position and wherein detaching the cover from the actuating unit uncovers the locking cylinder.

2. The handle device as claimed in claim 1, in which the actuating unit has an actuating element, the cover being arranged on the actuating element.

3. The handle device as claimed in claim 2, in which the actuating element has a receiving extension, detachably connected to the cover.

4. The handle device as claimed in claim 1, including a handle mount.

5. The handle device as claimed in claim 4, in which the actuating element is accommodated pivotably on the handle mount.

6. The handle device as claimed in claim 1, in which the cover conceals the locking cylinder with respect to an outer side of the handle device and partially uncovers said locking cylinder upon manual actuation.

7. The handle device as claimed in claim 1, in which the handle device has a handle shell with an elongate extent in which, at least in the rest position, the handle part lies with a likewise elongate extent flush with an outer side of the door, the cover being arranged as an extension of the elongate extent of the handle part and adjacent to the handle part.

8. The handle device as claimed in claim 1, in which, upon actuation of the actuating unit, the cover pivots in the direction of the handle part such that the cover pivots under the handle part.

9. The handle device as claimed in claim 2, in which the cover is fastened with a form-fitting connection to the actuating element, and the form-fitting connection can be released by movement of the cover in a removal direction.

10. The handle device as claimed in claim 9, in which the form-fitting connection between the cover and the actuating element has a slot guide, and the form-fitting connection can be released by movement of the cover in the removal direction.

11. The handle device as claimed in claim 1, in which the cover has a tool guide into which a tool can be introduced, the tool guide being accessible when the cover is transferred by manual actuation into the activation position.

12. The handle device as claimed in claim 10, in which the actuating element has a latching means which can be latched into a mating latching means on the cover in order to prevent movement of the cover in the removal direction.

13. The handle device as claimed in claim 12, in which the latching means is an extension of a tool guide, and, upon introduction of a tool into the tool guide, the latching means is detached from the mating latching means by interaction of the tool with the latching means.

14. The handle device as claimed in claim 12, in which a geometrical design of a tool guide and interaction of a tool with the latching means are designed in such a manner that the tool can be configured in the form of a key which is provided for actuating the locking cylinder.

15. A method for releasing a locking cylinder of a locking device of a vehicle, said locking device including a handle device having a handle part mounted movably with respect to a door of the vehicle, said handle part being movable between a rest position and an operating position, wherein, in the rest position, the handle part is arranged flush with respect to an outer side of the door and, in the operating position, said handle part protrudes out of the outer side of the door, wherein the handle part can be operated manually in the operating position in order to open the door, and said handle device includes a movably mounted actuating unit operatively connected to the handle part, wherein when the actuating unit is activated, the handle part moves at least from the rest position into the operating position, a cover arranged flush with an outer side of the door in the rest position detachably mounted directly to the actuating unit can be detached from the actuating unit and can be transferred by manual actuation into an activation position, and a tool is provided, with which the cover can be detached from the actuating unit, and in that the locking cylinder is arranged in the handle device in such a manner that the locking cylinder is uncovered by detaching of the cover, said method comprising:

detaching the cover from the actuating unit and uncovering the locking cylinder using the tool.

16. The method as claimed in claim 15, in which the cover has a tool guide into which the tool is introduced, said method including transferring the cover by manual actuation into an activation position in order to render the tool guide accessible.

17. The method as claimed in claim 16, in which the actuating element has a latching means, said method including latching said latching means into a mating latching means on the cover in order to prevent movement of the cover in a removal direction.

18. The method as claimed in claim 17, in which the latching means is arranged as an extension of the tool guide, said method includes introducing the tool into the tool guide, to detach the latching means from the mating latching means by interaction of the tool with the latching means.

19. The method as claimed in claim 16, in which the uncovering of the locking cylinder comprises the following steps prior to detaching the cover from the actuating unit:

manually actuating the actuating unit, introducing the tool into a tool guide in the cover, releasing the latching connection of the latching means from the mating latching means, and moving the cover in the removal direction.

* * * * *

UNITED STATES PATENT AND TRADEMARK OFFICE

CERTIFICATE OF CORRECTION

PATENT NO. : 8,985,648 B2
APPLICATION NO. : 13/502706
DATED : March 24, 2015
INVENTOR(S) : Dirk Muller et al.

It is certified that error appears in the above-identified patent and that said Letters Patent is hereby corrected as shown below:

In the Specification

Column 6, line 56
"part can be" should be --part 10 can be--

Signed and Sealed this
Twenty-ninth Day of September, 2015

Michelle K. Lee

Michelle K. Lee
*Director of the United States Patent and Trademark Office*